United States Patent [19]

Popkes

[11] 4,338,338

[45] Jul. 6, 1982

[54] BEVERAGE STRAINERS

[76] Inventor: Opal L. Popkes, 25 E. Clearview Dr., Columbia, Mo. 65201

[21] Appl. No.: 209,990

[22] Filed: Nov. 24, 1980

[51] Int. Cl.[3] ..... A47J 31/13; B65B 29/02

[52] U.S. Cl. ..... 426/82; 99/323; 426/77; 426/81; 426/110

[58] Field of Search ..... 99/323, 316, 317, 318, 99/321, 322; 426/72, 78, 82, 81, 80, 112, 115, 110, 77

[56] References Cited

U.S. PATENT DOCUMENTS

| | | | |
|---|---|---|---|
| 453,972 | 6/1891 | Gray | 99/323 |
| 880,190 | 2/1908 | Bultzingslowen | 99/323 |
| 1,367,568 | 2/1921 | Smith | 99/323 |
| 1,601,613 | 9/1926 | Fenyves | 99/323 |
| 2,570,521 | 10/1951 | Chester | 99/323 |
| 3,154,418 | 10/1964 | Lovell | 426/78 |
| 3,946,652 | 3/1976 | Gorin | 99/323 |

*Primary Examiner*—Robert W. Jenkins
*Attorney, Agent, or Firm*—Thomas M. Scofield

[57] ABSTRACT

Improvements in beverage, particularly tea and coffee, strainers; dispensing packages for tea and coffee in the manner of a spoon with the dry, water soluble or extractive beverage materials and optional condiments received in portions of the spoon; improved spoon package dispensers for water soluble or extractive beverages such as tea and coffee; tea and coffee individual serving packages functioning additionally as spoons in use.

11 Claims, 12 Drawing Figures

Fig. 1.
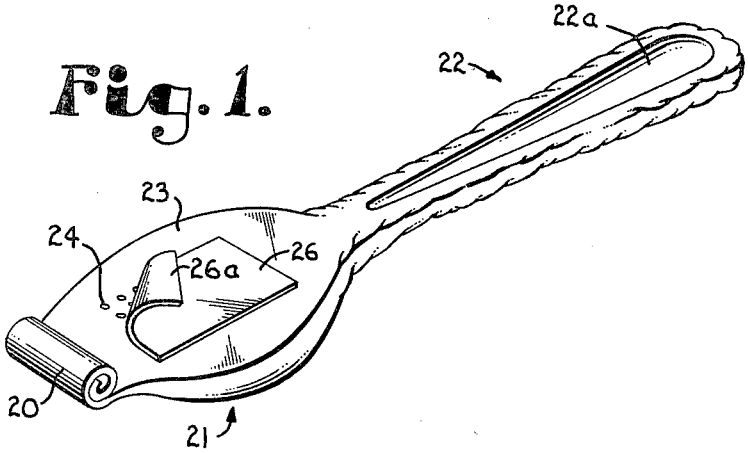
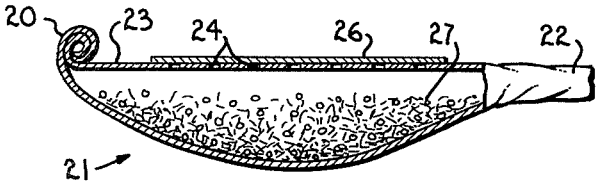
Fig. 2.
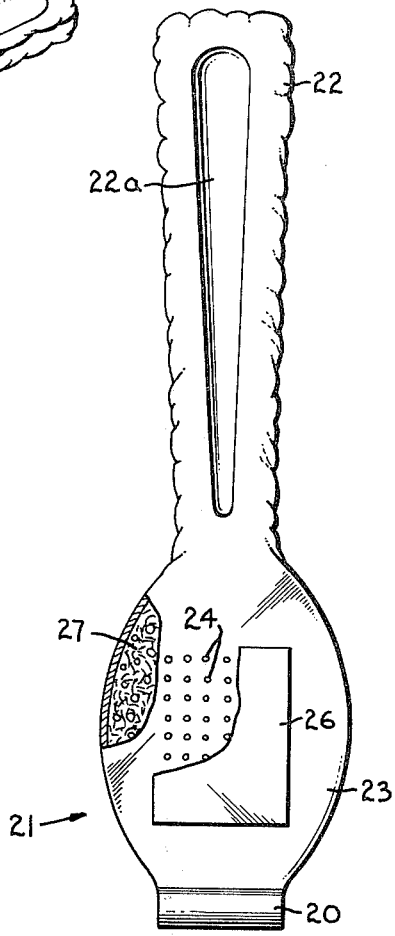
Fig. 3.
Fig. 4.
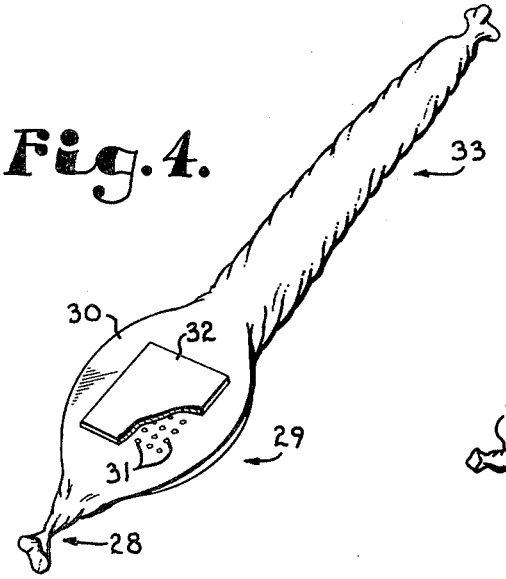
Fig. 5.
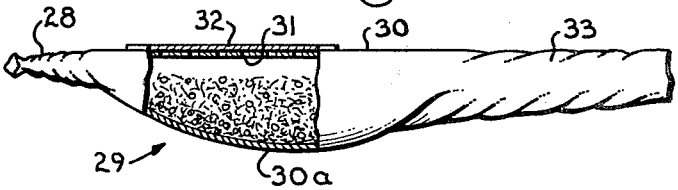

Fig. 6.
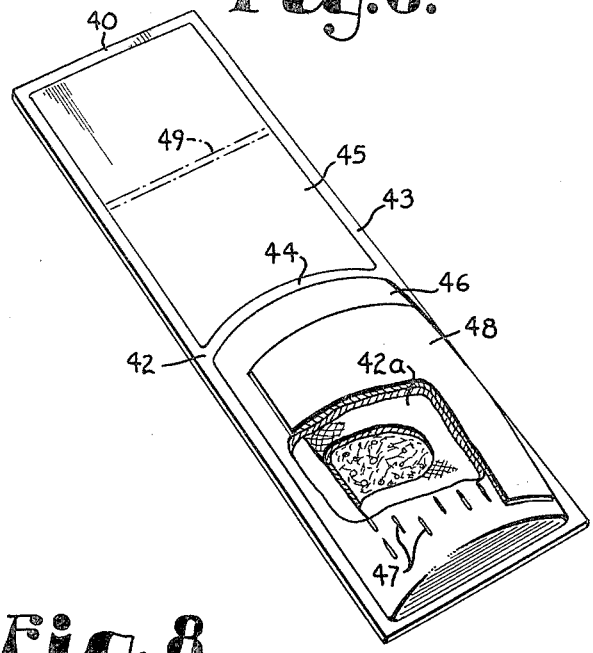
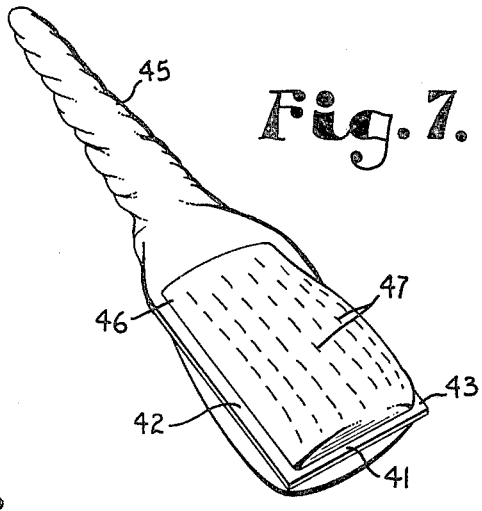
Fig. 7.
Fig. 8.
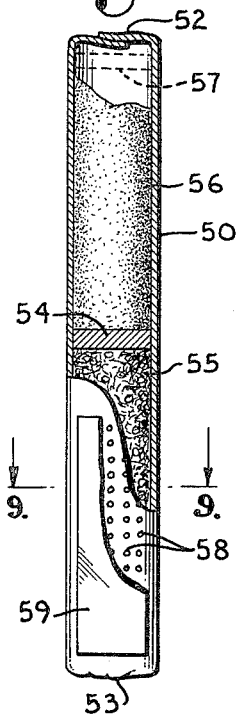
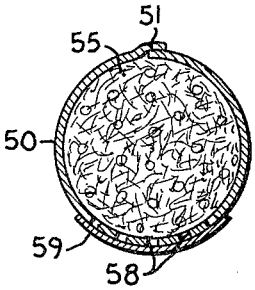
Fig. 9.
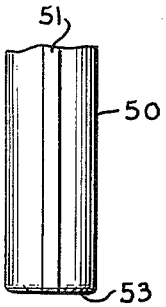
Fig. 10.
Fig. 11.
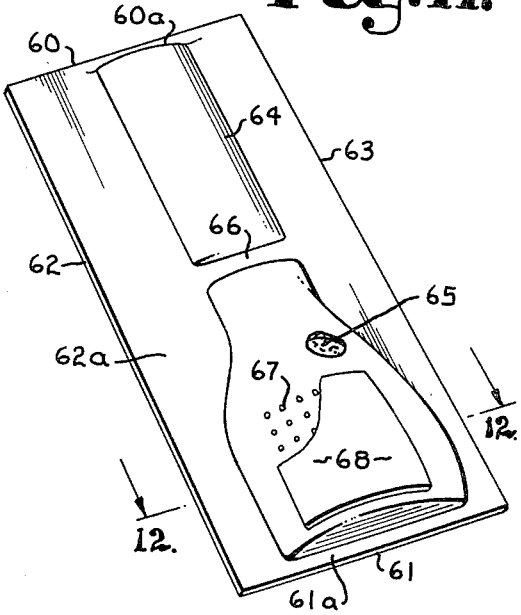
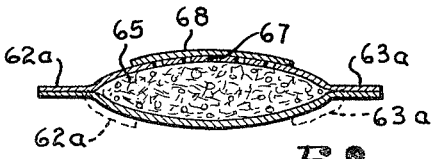
Fig. 12.

BEVERAGE STRAINERS

BACKGROUND OF THE INVENTION

Tea strainers for individual beverage portions by way of (or construction related to) spoons are well known in the art. The most common such construction is to have a perforated container of oval configuration in the cup zone of the spoon with a handle attached thereto. When made of metal, these devices are typically cleanable and reuseable. However, in such case, they must be individually charged and cleaned after use. Such structures are typically complicated and relatively expensive, also not readily adaptable to cheap mass production. Additionally, the parts thereof are easily disengaged, damaged or lost. Yet further, strainers cannot serve as storage containers for individual beverage servings or charges.

It is also known to provide plastic spoons of conventional shape which are hollow in character to carry the tea or coffee, perforations provided in a portion of the bowl for access of water to the dry, beverage making particles.

What has not hitherto been satisfactorily provided is a dispensing package which is disposable after use, cheap and simple to mass produce, manufacture and sell, which is an effective storage container for the beverage and yet additionally adequately functions as a spoon. Such a strainer or package should concentrate the tea or coffee in the spoon cup package, seal it before use against air contact, readily permit access of water to the beverage making material after unsealing, optionally provide a sealed space for sugar and the like, function effectively as a spoon for stirring and heat exchange and, finally, be readily disposable without mess or requirement of cleaning.

These considerations have given rise to the subject inventions.

THE PRIOR ART

Applicant is aware of the following prior art patents directed to tea and coffee strainers or dispensing spoons for holding such beverage making materials:

Gray U.S. Pat. No. 453,972 "Spoon", issued June 9, 1891;

Bultzingslowen U.S. Pat. No. 880,190 "Tea Strainer", issued Feb. 25, 1908;

Smith U.S. Pat. No. 1,367,568 "Spoon For Making Tea, Coffee . . . ", issued Feb. 8, 1921;

Fenyves U.S. Pat. No. 1,601,613 "Teaspoon", issued Sept. 28, 1926;

Chester U.S. Pat. No. 2,570,521 "Measuring Device For Tea . . . ", issued Oct. 9, 1951; and Gorin U.S. Pat. No. 3,946,652 "Dispensing Spoon", issued Mar. 30, 1976.

OBJECTS OF THE INVENTION

A first object of the invention is to provide improved dispensing packages for individual quantities of tea, coffee and the like.

Another object of the invention is to provide improvements in spoon-like or spoon useable dispensing packages for water soluble beverages such as tea and coffee.

Another object of the invention is to provide individual dispensing packages for water soluble beverages and condiments therefor which effectively seal and protect the contents of the packages over long periods of time to maintain freshness, are readily opened and used with a minimum of effort and which are readily disposable after use.

Another object of the invention is to provide simple foil packages to receive tea, coffee and other water soluble beverage materials which may be shaped as spoons in the manufacturing process by the seller or by the user, individually, when the package is employed by the ultimate consumer.

Another object of the invention is to provide such improved spoon type dispensing packages which are simple and easy to manufacture, rugged and durable for packaging, transport, storage and sale, which are yet simple and convenient to use and attractive to the consumer, as well as of minimum cost.

Another object of the invention is to provide such dispensing packages also useable as spoons which are capable of carrying advertising messages on the parts thereof.

Other and further objects of the invention will appear in the course of the following description thereof.

THE DRAWINGS

In the drawings, which form a part of the instant specification and are to be read in conjunction therewith, embodiments of the invention are shown and, in the various views, like numerals are employed to indicate like parts.

FIGS. 1–3, inclusive show a first modification of the invention wherein a metallic foil sheet is machined or hand formed to approximate spoon configuration with the cup of the spoon acting as a container for tea or coffee.

FIG. 1 is a three quarter perspective view from above of the first form of the invention, the sealing label shown partially removed from the portion of the spoon cup having perforations or slits therein for water access.

FIG. 2 is a fragmentary section through the bowl or cup of the spoon seen in FIG. 1.

FIG. 3 is a top elevation of the spoon dispensing package of FIGS. 1 and 2 with parts thereof cut away to better illustrate the construction.

FIGS. 4 and 5 show a modification of the subject invention where the handle portion of the spoon type dispenser, the sealing of the foil sheet and handle and an optional weighting portion thereof are provided by twirling or twisting of the original sheet for closure and shaping.

FIG. 4 is a three quarter perspective view from above of a modification of the subject device with a portion of the sealing label removed for better disclosure of the perforations thereon.

FIG. 5 is a side view of the cup or bowl portion of the device of FIG. 4 with a portion thereof in section to better illustrate the construction.

FIGS. 6 and 7 show an essentially flat foil envelope having a tea or coffee container at one end thereof, the other end left essentially flat so it can be twirled or twisted to handle configuration by the user at the time of application or use.

FIG. 6 is a three quarter perspective view from above of another modification of the subject device. A portion of the sealing label on the bowl or cup portion of the spoon is cut away for illustrative purposes.

FIG. 7 is a view like that of FIG. 6 showing the handle portion of the package twisted by the user to form a structurally stronger portion for grasping and manipulation as a handle.

FIGS. 8–10, inclusive show a cylindrical form of the subject invention having a tea or coffee container at one end, there being a barrier centrally thereof and an optional sugar or saccharin container at the other end.

FIG. 8 is a top plan view of a fourth form of the subject dispensing container with portions thereof cut away and in section to better illustrate the internal construction.

FIG. 9 is a view taken along the line 9—9 of FIG. 8 in the direction of the arrows.

FIG. 10 is a fragmentary lower end view of the device in FIG. 8 showing the seam and end closure construction.

FIGS. 11 and 12 show a form of the device where two foil sheets are heat sealed along their sides and centrally thereof to provide a central spoon configuration having a beverage container at one end and condiment container at the other.

FIG. 11 is a three quarter perspective view from above of a fifth form of the subject invention with a portion of the sealing label thereon cut away to illustrate the perforations therein.

FIG. 12 is a view taken along the line 12—12 of FIG. 11 in the direction of the arrows.

FIGS. 1–5, INCLUSIVE

Referring to FIGS. 1–3, inclusive, therein is shown a first modification of the invention wherein a metallic foil sheet is machine or hand formed to approximate spoon configuration, with the ultimate "cup" of the spoon configuration serving as a sealing container for a charge or quantity of dry tea or coffee. This construction may be formed in a number of ways, but is most simply provided out of a simple, rectangular sheet of metal foil. This is optionally faced on one side thereof with water permeable paper or a plastic sheet to make a laminate and, additionally, is provided with perforations in a limited zone of the foil. In the event that the foil is not permeable paper faced on one side thereof, in whole or part, the holes through the foil are preferably initially sealed with a patch or flap of plastic or paper having adhesive on one side thereof and applied to the outer side of the sheet.

Assuming, then, that a rectangular sheet of metal foil is laid down upon a flat surface, there being a series of perforations or slits therethrough centrally thereof and toward one end, the foil either permeable paper faced on the side up or orifice or perforation sealed on the side down (or both), the assembly may take place as follows. First, a charge of coffee or tea is laid or placed directly on the perforated zone in a small mound. One side flap of the foil is then folded over across substantially the entire body of tea or coffee the length of the sheet. Thereafter, the other flap is folded over the coffee and tea and over the first fold. This, then, gives essentially a tube of foil open at both ends.

Assuming an aluminum foil rectangular sheet having a perforated zone adjacent one end centrally, there may be:

(1) the entire inner (upper) side laminated with permeable paper or only the perforated zone;

(2) the outer (lower) face provided with a removable seal patch over the openings;

(3) a plastic sheet such as polyethylene or polypropylene providing a laminate on the inner upper side of the foil sheet, in which case this will be perforated in registry with the foil sheet perforations, and there will be provided a patch seal on the lower outer face as in (2).

Such tube may be sealed along the entire length thereof with a heat seal or ultrasonic welding seal (the former if a laminate sheet is suitable plastic) or an equivalent of "scotch tape". At this point, then, it is necessary to seal and close both ends of the formed tube (by means such as may be seen in FIGS. 1–3, inclusive as one modification and FIGS. 4 and 5 as another modification).

Referring, first, to FIGS. 1–3, inclusive, the short end of the tube is tightly rolled up in a sealing cylinder. The far or longer end of the tube has been folded upon itself or crumpled upon itself and, thereafter, a stamp has compressed an elongate groove in the folded or crumpled end of the "spoon" to form a more rigid handle.

The above described steps result in a spoon construction, as seen in FIGS. 1–3, inclusive wherein a metal foil sheet is folded upon itself and rolled, crumpled, folded and stamped to provide a sealed end portion 20 in the form of a cylindrical roll, a bowl portion generally designated 21 and a handle portion generally designated 22. Bowl 21 has upper flattened face 23 with openings 24 therethrough. The underside of the bowl is designated 25. A flap of sealing material such as waterproof paper or plastic sheet 26 has adhesive on its underside 26*a* to removably seal to flat upper face 23 of bowl 21.

The handle 22, which is here shown as the extended foil portion folded over upon itself and then hand or machine crumpled to a substantial cylindrical shape has an elongate indentation 22*a* stamped therein, preferably by machine, in order to rigidify and broaden the "handle" for convenient and useful application. The tea 27 (FIG. 3) is accessible by water to openings 24 after flap 26 is pulled therefrom.

The construction of FIGS. 4 and 5 differs from the construction of FIGS. 1–3, inclusive only in the fact that the short end and the long end of the metallic foil sheet (water permeable paper faced or not) is twirled at each end to effect the seal, thus providing a less spoon resembling shape. In FIGS. 4 and 5, short end portion 28 closes one end of bowl portion 29 which has preferably flat upper surface 30 with openings 31 therethrough. Sealing flap or patch 32 of water proof paper or plastic (or, alternatively, metal foil) is removably and adhesively secured to the face 30. The handle portion 33 is a twirled length of the previously described metallic foil sheet. Also as previously described, the metal foil sheet may be plastic faced on one side (the inside). If such is the case, the perforations 31 must be through the plastic also. In the event the metal foil is water permeable paper faced on the inside, the openings 31 do not pass through the paper. The underside of the bowl 30*a* is seen in FIG. 5. In the event that the "spoon" is formed as seen in FIGS. 4 and 5 by twisting, the seal may be increased or completed at both ends, or one of them, by ultrasonic welding or heat sealing (the latter if a suitable plastic facing is provided on the inner face of the metal foil sheet). The flat top portions 23 and 30 of the two forms being described may be provided by machine forming of the device or, alternatively, if the "spoons" are hand formed, merely by forcing one face of the spoon against a flat surface while the final forming takes place.

In operation of the spoon of FIG. 1, with the coffee or tea 27 sealed within the bowl 21 by the curling, crimping, folding, etc. of end portion 20 and end portion 22, the device may be stored indefinitely with the tea or coffee retaining its freshness. When the device is desired to be used, it is taken out of the container and the plastic or paper strip 26 pulled away from opening 24. The bowl portion of the spoon may then be dipped in a cup or other container of extremely hot water to extract the tea or coffee, together with what other flavorings may be within the bowl . The operator grasps the handle 22 in conventional spoon fashion and may use the construction to stir the water or other liquid in the cup or other container when sugar and/or cream, etc. is added.

The operation of the construction of FIGS. 4 and 5 is no different from that of FIGS. 1–3, inclusive as described. That is, once the sealing of the bowl is effected by twisting, twirling, or folding of the ends 28 and 33 (with or without mechanical stamping, heat sealing and/or ultrasonic welding), the "spoon" containing the coffee or tea or other soluble beverage may be stored indefinitely. When desired to be used, the patch or label 32 is stripped from the openings 31. When the bowl end of the "spoon" is dipped into hot water or other liquid the tea or coffee is water dissolved or extracted into the liquid.

With respect to the materials, aluminum foil is best useable with the subject invention. In the event heat sealing is desired, polyethylene and polypropylene are heat sealable to themselves and one another and may be used as the internal member of a film laminate with aluminum on the outer layer and the polyethylene or polypropylene as the interior layer. In such case, the openings must be made through the laminate and a sealing patch employed. In all cases, even when water permeable paper is an interior laminate or patch over the openings, an outer, removable sealing patch or flap 26 or 32 is preferably employed.

FIGS. 6 AND 7

In this modification of the invention, two foil sheets (such as aluminum foil) are laid on a flat surface, having placed between them, at one end, a quantity of dry tea, coffee or other water soluble condiment. By hand or machine sealing (such as a heat seal or ultrasonic weld, the two sheets are sealed to one another along the peripheral edges thereof and, additionally, a seal is provided across the center or towards one end of the sheets to confine the dry tea or coffee in a cell or compartment by itself.

In the specific embodiment of FIGS. 6 and 7, two rectangular sheets of aluminum foil have been ultrasonically welded to one another to provide an elongate, integral rectangular package having end edges 40 and 41 and side edges 42 and 43. These edges are all integrally bonded to one another. Additionally, there is provided a transverse (here substantially central) ultrasonic weld 44 which provides an unfilled (optionally) cell 45 at the handle end of the device and a filled cell 46 at the bowl end of the device. A plurality of slits, slots or orifices 47 are provided in the latter cell, same initially covered by a plastic or paper seal or label 48 which has adhesive on its inward side. Any suitable attachment for the foil sheets including metal glue may be employed. If the foil sheets have (perforated) inboard laminate plastic sheets integral therewith, these laminates may be heat sealed together.

The position of an optional ultrasonic weld or heat seal in the handle end or cell 45 is shown at 49. This seal may be employed to hold sugar in the outboard or inboard portion of cell 45 (or on both sides thereof to give variable quantities available for use).

In order to get access to the sugar in one or both of the cells, suitable access may be provided by way of tabs over openings as in the other end of the device or slitting or cutting may be required. The provision of sugar, saccharin or other condiment is optional in the handle. It should also be noted that additional lengthwise ultrasonic welds or heat seals may be provided in the handle cell 45 or the entire cell heat sealed upon itself or criss-cross seals or the like employed. What is desired to be available, (once the individual device is selected for use and the sealing label or patch 48 pulled from the openings, and, if present, sugar or other condiment taken from the cell 45 or any part thereof), is a metal foil handle extension which may be folded, twisted or twirled upon itself as seen in FIG. 7 to provide a handle so that the condiment containing end of the bag or construction may be used as the bowl of the spoon. Thus, FIG. 7 shows the label or patch 48 removed from the portions of the bag or container having openings 47 therein to expose same and handle cell 45 twisted to form an integral, stiffer handle portion.

Again, the portion of one of the sheets of foil having openings 47 therein may be covered with water permeable paper or the like. Both faces of the device may have perforations therein and labels or covers 48 thereover. One or both of the labels may be removed for use. If the foil sheets are polyethylene or polypropylene (or other appropriate plastic) inwardly faced, then the device may be heat sealed, rather than ultrasonically welded or otherwise attached to one itself. In such case, perforations will also have to be provided through one or more plastic sheets at the openings 47 through the foil sheets.

For versatility in fabrication or manufacture, the extractible material (tea, coffee, etc.) may be provided in a bag for sealing into the foil or other material cover. This is seen at **42*a*** and may be employed in other forms. The texture and permeability of the bag paper depends on the material, its grind, etc.

The purpose of providing aluminum or other suitable metal foil in the devices already described and to be described is multi-fold. In the first place, it is attractive in appearance. Secondly, it may be completely sterilized and cleaned. Thirdly, it may be readily faced with liquid permeable paper or heat sealable plastic sheets or the like. Yet further, it is bendable and shapeable in forming, even by hand or by machine. Yet further, portions thereof, such as the short and long ends in the earlier figures and the long end in the just described figures, may be rolled, crimped, twisted, twirled or the like to form a stiff or stiffer handle portion in combination with the beverage or condiment (or both) bowl portion. Yet further, the foil itself, in single or laminate thicknesses, once formed, is strong enough, typically, to retain bowl shape in use and storage, as well as reasonable handling. The forming, as noted, with respect to handles, may include folding of the foil or laminate upon itself, crumpling upon itself, folding and crumpling, twisting, twirling or any combination of these actions to obtain the desired, relatively strong, shape retaining structure.

FIGS. 8–10, INCLUSIVE

These figures show an elongate cylinder form of the subject invention having a dry condiment cell at one end thereof, a central barrier within the tube and an optional sugar, saccharin or other condiment cell at the other end.

In this form of the invention, there is provided a cylindrical tube whose side wall 50 (generally designated) is of, preferably, relatively stiffer foil than is seen in the previous figures. The cylinder has a seam (FIGS. 9 and 10) 51 formed of an overlap of the end edges of the foil sheet, this seam sealed by heat seal or ultrasonic weld in its entire length. The ends of the cylindrical tube or container, after filling, as will be described, are folded, twirled (not shown), twisted or the like to a sealing closure with conventional glue, adhesive, heat seal or ultrasonic weld seal in a manner which permits relatively easy opening thereof, as seen at 52 (outer end) and 53 (inner end).

A barrier or wall 54 of metal, plastic, wood or the like divides the interior of tube 50 into compartment 55 (containing tea, coffee or other liquid soluble condiment) and 56 (containing sugar, saccharin or like flavoring agent or additional condiment). Optionally, a second plug or seal 57 may be provided at or adjacent end 52 to aid in sealing and confining both charges of material between end 53 and plugs 54 and 57. Another plug (not shown) may block end 53 and aid closure, seal and shape retention.

At least one cell (here 55) has a plurality of openings, slits or slots 58 through the wall thereof, same covered before use by flap, patch or sheet 59 of plastic, paper, metal foil or the like having adhesive on one side thereof. Typically, although the cells in FIGS. 8–10, inclusive are shown of equal size, the tea or coffee containing cell 55 will be of lesser length than cell 56 or the entire outboard length (to end 52) of the container. The purpose of this is to provide, as is seen in FIGS. 6 and 7 and the previous figures, a more elongate handle type portion which, after optionally discharging its load or charge or sugar, saccharin or the like, may be twisted, twirled or folded upon itself to provide a relatively rigid handle portion to permit the use of the entire device as a stirrer with the condiment containing portion in the spoon bowl end thereof.

In operation of the device of FIGS. 9 and 10, optionally, first, end 52 may be opened and sugar or saccharin poured into the hot water in a cup or container. As another option, alternatively, the seal strip 59 is pulled away from openings 58 and the tea or coffee end stirred in the water of the container to cause water to extract tea or coffee from the grains of same inside the container. As previously stated, there may be a plastic and/or paper lining, or both, the plastic being perforated also, to provide the access of extracting liquid to the extractable material.

Whether or not the outer cell 56 is discharged of its contents, this end may be employed as a grasping handle to stir the other end in the tea or coffee as is the case in all of the constructions heretofore described and this immediately described construction, once the user has employed the device to provide a cup of tea or coffee, with or without flavoring or condiment, then the entire construction may be discarded or thrown away.

FIGS. 11 AND 12

In this structure, folding of the foil container upon itself is largely employed to provide the relatively stiff and strong handle portion. What is here provided is, alternatively, a pair of rectangular foil sheets sealed to one another by, typically, ultrasonic welding or, alternatively, polyethylene or polypropylene (or other plastic) inwardly faced foil sheets which are heat sealed to one another. This provides an ultimate product having end edges 60 and 61 and elongate side edges 62 and 63. There are end edge seals 60*a* and 61*a* running across the entire end edges and the side edge seals 62*a* and 63*a* also running along the sides, but configured so as to be of greater inward penetration into the sheets at the handle end.

Additionally, transverse seal 66 provides two cells, specifically, 64 in the handle end and 65 in the cup end. The additional transverse heat seal or ultrasonic weld 66 runs seal 62*a* to seal 63*a* providing complete isolation of the cells, one from the other. Cell 64 may contain sugar, saccharin or other condiment, such as cream in a dry form. Cell 65 contains coffee or tea in dry, preservable form and has perforations, slits or openings 67 therein covered, before use, and sealed by patch or flap 68 which has adhesive on the inward side thereof.

In use of the device of FIGS. 11 and 12, typically, first, the side seals 62*a* and 63*a* are folded downwardly (FIG. 12) into contact with the underside of cells 65 and 64. It should be noted that the greater width of the outboard seals 62*a* and 63*a* will permit overlapping thereof in the zone of cell 64 for very considerably greater rigidity. They may additionally be twisted in their outer portions if cell 64 is empty or after it is drained.

Thereafter, in one option, the flap 68 is stripped from opening 67 and the coffee or tea extracted by contact with water which the cell 65 is stirred. Following this, the cell 64 may be breached to provide sugar and/or powdered cream to the water. This may be done before the extraction of the coffee or tea, optionally. In the event that it is desired to provide either sugar or saccharin or one of these and powdered cream, the cell 64 may be divided by another heat seal like that at 66 transverse the length of the device. The device itself may be lengthened as desired to provide one, two or three cells for such purposes.

CONCLUSIONS

Thus it has been shown that, from a simple rectangular sheet of metal foil, or a plurality of same, or (alternatively) same shaped in spoon configuration, cheap, effective storage and dispensing containers for tea and coffee or like beverages (water or liquid extractable) may be provided of simple materials with minimum processing and manufacturing effort. In all, the dry, extractible comestible such as tea or coffee is sealed in a spoon bowl-like container with attached handle so that it may be conveniently packed, handled and used in application, then discarded. The materials may be metal foil alone, plastic faced metal foil or paper partially or wholly faced metal foil, or combinations thereof. The mode of manufacturing may be mere rolling, twisting, twirling and crimping of the foil or laminate or incorporate ultrasonic welds, heat seals and other conventional attachment means. The constructions may be single celled, double celled, triple cell or multiple cells as desired. The handle portions may be initially crimped, twisted or twirled in position as in the constructions seen in FIGS. 1–5, inclusive or, alternatively, later twisted, twirled or crimped into form as in the later figures. Simple folding may be employed as in FIGS. 11 and 12.

The labels of the invention or portions of the bodies of the devices may be color-coded as required for marketing purposes. The subject disclosed improvements actually produce better, gourmet type coffee and tea beverages. Coffee gourmets recommend the drip type coffee produced by the subject devices as of the best quality.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A beverage strainer for an extractible dry beverage material such as tea or coffee, comprising, in combination:

a sheet of metal foil wrapped upon itself to provide an elongate, spoon-like hand manipulatable form, said form having at one end thereof a hollow, sealed pouch in substantial cup form containing a a quantity of liquid extractible dry beverage material therein, said pouch defined by at least one wall thickness of said foil sheet, and at the other end thereof, an elongate grasping handle connected to and extending from said pouch, said handle defined by said foil sheet wrapped upon itself in substantially closed, solid form, the pouch having a plurality of openings through the walls thereof in a group to permit access of liquid to the extractible material and means removably covering said openings to seal said pouch before use of said strainer.

2. A strainer as in claim 1 wherein the opening covering means is a removable patch with adhesive on one side thereof.

3. A strainer as in claim 1 wherein at least the cup portion of said strainer is a laminate with an inner wall of plastic material, the openings in said pouch being through said foil sheet and inner laminate wall and in registry with one another.

4. A strainer as in claim 1 including at least the area of said pouch having said openings therethrough is inwardly covered by liquid permeable paper.

5. A beverage strainer for an extractible dry beverage material such as tea or coffee, comprising, in combination:

a double wall sheet of metal foil sealed to itself to provide an elongate, rectangular, hand manipulatable form, said form having, at one end thereof, a hollow sealed pouch containing a quantity of liquid extractible dry beverage material therein, said pouch defined by at least one wall thickness of said foil sheet, and at the other end thereof, an elongate portion wrappable upon itself to form an elongate grasping handle connected and extending from said pouch, the pouch having a plurality of openings in the wall thereof to permit access of liquids to the extractible material, and means removably covering said openings to seal said pouch before use of said strainer.

6. A strainer as in claim 5 wherein said form has two sealed pouches therewithin, the second pouch having a condiment therein to add to the beverage created by extraction of the extractible material.

7. A strainer as in claim 5 wherein a substantial portion of the length of said form extending away from said pouch is the double wall thickness of foil attached to itself.

8. A strainer as in claim 5 wherein the portions of the pouch containing said openings have an inward facing of liquid permeable paper.

9. A strainer as in claim 5 wherein the form is made up of two sheets of metal foil connected to one another.

10. A strainer as in claim 5 wherein said metal foil sheet has at least the pouch portion thereof inwardly lined with plastic material with openings through the plastic in registry with the openings through the foil.

11. A strainer as in claim 5 wherein the opening covering means is a removable patch with a adhesive on one side thereof.

* * * * *